United States Patent [19]

Herrmann

[11] 3,985,338

[45] Oct. 12, 1976

[54] MANHOLE COVER LIFTER

[76] Inventor: Edgar R. Herrmann, 1431 Cottage St., NE., Salem, Oreg. 97303

[22] Filed: Nov. 17, 1975

[21] Appl. No.: 632,678

[52] U.S. Cl. ..... 254/131
[51] Int. Cl.[2] ..... B66F 3/00
[58] Field of Search ..... 254/131, 129, 130, 30; 294/17; 81/177 E, 177 D; 145/65

[56] References Cited

UNITED STATES PATENTS

| | | | |
|---|---|---|---|
| 1,396,591 | 11/1921 | Reist | 81/177 E |
| 1,511,395 | 10/1924 | Canan | 81/177 E |
| 2,099,592 | 11/1937 | Barton | 254/30 |
| 3,198,362 | 8/1965 | Berg | 254/131 |
| 3,275,299 | 9/1966 | Meshew | 254/131 |

FOREIGN PATENTS OR APPLICATIONS

| | | | |
|---|---|---|---|
| 320,796 | 10/1929 | United Kingdom | 254/131 |

*Primary Examiner*—Al Lawrence Smith
*Assistant Examiner*—Robert C. Watson

[57] ABSTRACT

A tool for breaking loose a manhole cover which has become sealed under an accumulation of road tar and dirt; the device consisting of a long lever which at one end has a hook for engaging an opening through the manhole cover, a fulcrum being located relatively close to the end of the lever having the hook, so that when a workman places his foot upon the other end of the lever, he can with very little effort pry the manhole upwardly for easy removal.

1 Claim, 4 Drawing Figures

MANHOLE COVER LIFTER

This invention relates generally to tools for use by city utilities department workers who are obliged to open up manholes in city and highway roads.

It is generally well known to those skilled in the art that it is a laborious task to break loose and lift a manhole cover on a street which may have become sealed under an inch or two of asphalt paving. An average manhole cover weight is approximately 129 pounds, and after a time, with heavy traffic traveling thereacross, and road oil and tar firmly sealing the cover in the manhole opening, it thus becomes very difficult to lift the manhole cover with just a plain hook. This situation is accordingly in want of an improvement.

Accordingly, it is the principal object of the present invention to provide a manhole cover lifter which eliminates the necessity of using the conventional plain hook for attempting to lift the manhole cover, the manhole cover lifter being operated by simply stepping thereupon, thus eliminating the necessity of any back-breaking bending and lifting.

Another object of the present invention is to provide a manhole cover lifter which eliminates the danger of an employee developing a back strain or other injury from attempting to dislodge a heavily sealed manhole cover.

Still another object of the present invention is to provide a manhole cover lifter which, besides making it easier to break loose a manhole cover, also accomplishes the same in a quicker length of time.

Other objects are to provide a manhole cover lifter which is simple in design, inexpensive to manufacture, rugged in construction, easy to use and efficient in operation.

These and other objects will be readily evident upon a study of the following specification and accompanying drawing, wherein.

Figure 1:
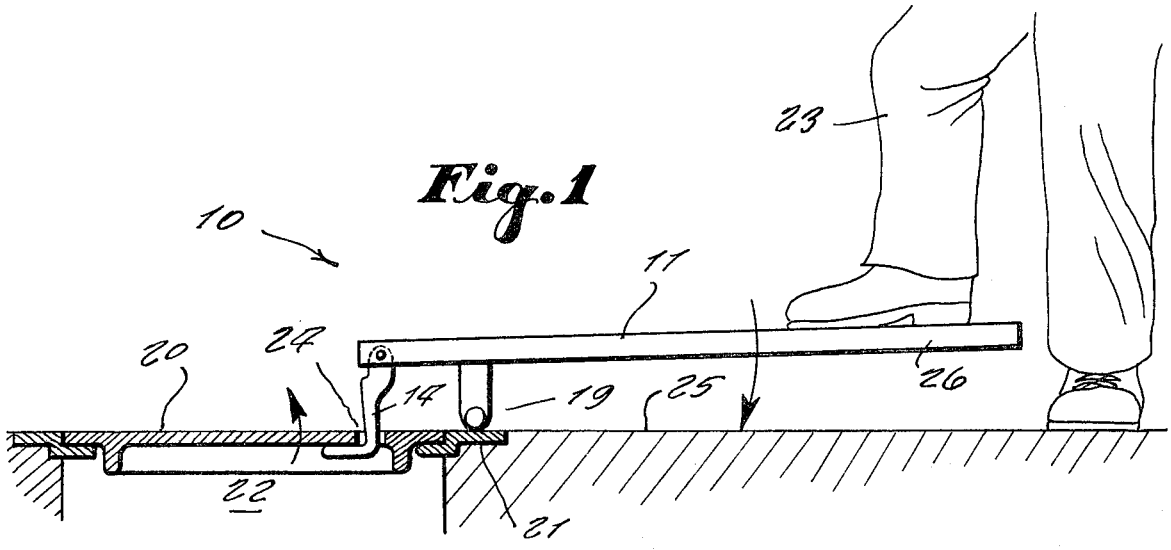
FIG. 1 is a side elevation view of the present invention shown in operative use.
Figure 2:
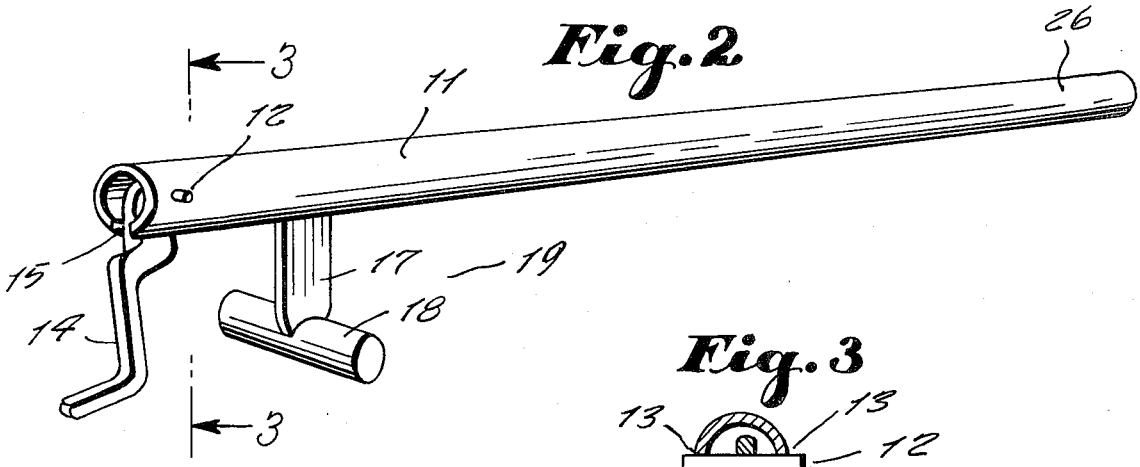
FIG. 2 is a perspective view of the invention shown per se.
Figure 3:
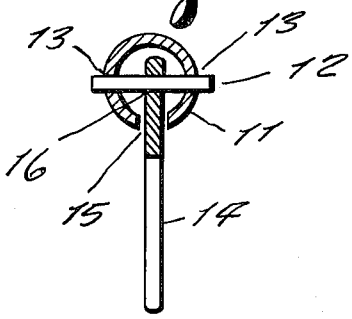
FIG. 3 is a cross sectional view taken on line 3—3 of FIG. 2.

Referring now to the drawing in greater detail, and more particularly to FIGS. 1 through 3 thereof at this time, the reference numeral 10 represents a manhole cover lifter according to the present invention, wherein there is a straight length of steel pipe 11, which at one end supports a transverse extending pin 12, supported in openings 13, the pin 13 supporting a hook 14, which extends downwardly therefrom and which extends through a slot 15, formed in the end of the pipe. The pin 12 extends through a transverse opening 16 formed in the hook.

Upon the underside of the pipe 11 and located relatively close to the pipe end which supports the hook, there is a downwardly extending lug 17 welded thereto, the lower end of the lug 17 having a cylindrical bar of steel 18 welded thereto so to form a foot, the foot together with the lug forming a fulcrum, as indicated by the reference numeral 19.

In operative use, in order to remove a manhole 20 that may have become stuck within a steel ring 21 installed around a manhole entrance 22, a workman 23 simply installs the hook 14 within an opening 24 of the manhole cover, so that the fulcrum 19 thus rests firmly upon the upper surface of the ring 21 or upon the street surface 25, so that the opposite end 26 of the pipe that serves as a handle may be stepped upon by the workman's feet in order that the workman may apply his body weight thereupon. The leverage thus applied upon the handle results in a great lifting force at the hook 14 so that the manhole cover can thus be quickly and easily pried upwardly in case it has become stuck due to asphalt or dirt. Thus, without any back-breaking effort, the workman quickly accomplishes the removal of the manhole cover so that he has access to the manhole.

Figure 4:
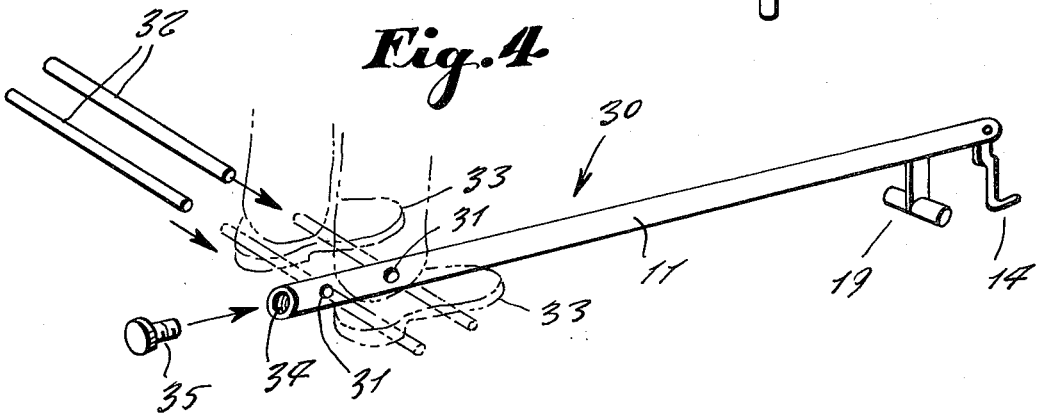
FIG. 4 is a perspective view of a slightly modified design of the invention which additionally incorporates a means whereby a worker, either alone or with another worker, can apply a full weight upon a lever in order to break loose a sealed manhole cover.

Referring now to FIG. 4 of the drawing, there is shown a modified design of manhole cover lifter 30, which is the same as the above described manhole cover lifter 10, except that it additionally includes two transverse openings 31 through the handle end of the pipe 11. Each of the transverse openings 31 are adaptable for two straight steel rods 32 being slideably fitted therewithin. When the steel rods are fitted through the openings 31 so that opposite ends of the rods protrude from opposite sides of the openings, as shown in FIG. 4, a workman may place both his feet 33 thereupon in order that he may comfortably stand thereon and apply his full weight thereupon, instead of only a single foot, as shown in FIG. 1. Thus the adjacent rods together form a grill that gives a secure support for both feet so that there is less likelihood for a workman to fall down than if applying only a single foot along a top edge of a rounded pipe.

When the rods 32 are not required, they may be stored within the interior of pipe 11 and the end of the pipe can be screw threaded as shown after 34 and fitted with a removable end cap 35. Thus the rods are readily handy should they be needed. Otherwise they may be retained in their stored position. It should be noted that the provision of the two steel rods allows two workmen to stand thereupon for applying a still greater weight for breaking loose a stuck manhole cover.

While various changes may be made in the detail construction, it is understood that such changes will be within the spirit and scope of the present invention as is defined by the appended claims.

What I now claim is:

1. A manhole cover lifter, comprising in combination, an elongated straight steel pipe, one end of said pipe having a transverse pin therethrough, said pin pivotally supporting a downward extending hook, and a fulcrum being welded to an underside of said steel pipe, said fulcrum being located relatively close to said end of said pipe that supports said hook, said fulcrum comprising a downward extending lug, which at its lower end is welded to a transverse extending steel bar, an opposite end of said steel pipe being provided with a pair of transverse, spaced apart extending openings therethrough, each said openings removably receiving a straight steel rod, said steel rods protruding from opposite ends of said transverse openings, thus forming a grill upon which a person can stand, said steel rods, when removed from said transverse openings, being stored within an interior of said pipe, said opposite end of said steel pipe having a threaded opening receiving a removable end cap, said steel rods being of a diameter that is smaller than the central opening of said pipe, so to slideably be received therewithin, and said steel rods, together, being shorter than the length of said pipe central opening, so as to be fully fitted therewithin.

* * * * *